US011247093B2

(12) United States Patent
Chiang

(10) Patent No.: US 11,247,093 B2
(45) Date of Patent: Feb. 15, 2022

(54) DUMBBELL WITH ADJUSTABLE WEIGHT

(71) Applicant: Yih An Exnt. Co., Ltd., Taichung (TW)

(72) Inventor: Chieh-Lung Chiang, Taichung (TW)

(73) Assignee: Yih An Exnt. Co., Ltd., Taichung (TW)

( * ) Notice: Subject to any disclaimer, the term of this patent is extended or adjusted under 35 U.S.C. 154(b) by 0 days.

(21) Appl. No.: 16/909,816

(22) Filed: Jun. 23, 2020

(65) Prior Publication Data

US 2021/0283452 A1 Sep. 16, 2021

(30) Foreign Application Priority Data

Mar. 11, 2020 (TW) ..... 109202783

(51) Int. Cl.
*A63B 21/072* (2006.01)
*A63B 21/075* (2006.01)
*A63B 21/06* (2006.01)

(52) U.S. Cl.
CPC ..... *A63B 21/0728* (2013.01); *A63B 21/0602* (2013.01); *A63B 21/0603* (2013.01); *A63B 21/075* (2013.01); *A63B 21/0726* (2013.01)

(58) Field of Classification Search
CPC ..... A61B 21/0728; A61B 21/075; A61B 21/0603; A61B 21/0602; A61B 21/0726; A61B 21/072–075
See application file for complete search history.

(56) References Cited

U.S. PATENT DOCUMENTS 4,971,318 A * 11/1990 Tracy ..... A63B 21/0728 482/107
6,682,464 B2 * 1/2004 Shifferaw ..... A63B 21/0728 482/104
7,018,325 B2 * 3/2006 Shifferaw ..... A63B 21/4031 482/104
9,956,451 B1 * 5/2018 Wang ..... A63B 21/0728
10,328,299 B2 * 6/2019 Wang ..... A63B 21/075
2005/0075221 A1 * 4/2005 Fond ..... A63B 21/0728 482/93
2014/0349820 A1 * 11/2014 Wang ..... A63B 21/0726 482/108

* cited by examiner

*Primary Examiner* — Megan Anderson
*Assistant Examiner* — Kathleen M Fisk
(74) *Attorney, Agent, or Firm* — Bradley J. Thorson; DeWitt LLP

(57) ABSTRACT

A dumbbell has a grip rod and multiple counterweight blocks. The grip rod has two connection segments each having multiple baffles to define multiple connection recesses between the baffles. The counterweight blocks are engaged respectively with the connection recesses. Each counterweight block has a body and a buckle. The body has an engaging channel extending from a center to an edge of the body and being expandable. The engaging channel has an opening and two protrusions to form an engaging space for being mounted around one of the connection segments. The buckle has a first end and a second end. The first end is connected pivotally to the body and at a position on one of two sides of the engaging channel. The second end is connected detachably with the body at a position on the other one of the two sides of the engaging channel.

10 Claims, 5 Drawing Sheets

DUMBBELL WITH ADJUSTABLE WEIGHT

BACKGROUND OF THE INVENTION

1. Field of the Invention

The present invention relates to an exercising device, and more particularly to a dumbbell that is easy, rapid and convenient in weight-adjusting.

2. Description of Related Art

A conventional dumbbell with an adjustable weight substantially comprises a grip rod and multiple counterweight blocks mounted around two ends of the grip rod. Each counterweight block has a round hole defined in a center of the counterweight block. Two limiting elements are mounted on the grip rod respectively at positions adjacent to the outermost two of the counterweight blocks to hold the counterweight blocks on the grip rod.

However, to adjust the weight of the conventional dumbbell, the limiting elements have to be detached from the grip rod first. Then, the counterweight blocks should be removed from the outermost ones or new counterweight blocks should be attached to the grip rod from two ends of the grip rod. Finally, the two limiting elements are attached to the grip rod again. therefore, to conventional dumbbell is trouble, time-consuming, and inconvenient in adjusting the weight. In addition, the counterweight blocks have to be attached or removed from outside to inside and the attachment positions of the counterweight blocks cannot be chosen freely, so the variety of the counterweight way of the conventional dumbbell is not versatile.

To overcome the shortcomings, the present invention tends to provide a dumbbell to mitigate or obviate the aforementioned problems.

SUMMARY OF THE INVENTION

The main objective of the invention is to provide a dumbbell that is easy and convenient in adjusting weight.

The dumbbell has a grip rod and multiple counterweight blocks. The grip rod has two connection segments formed respectively on two ends of the grip rod. Each connection segment has multiple baffles formed on the connection segment at spaced interval to define multiple connection recesses between the baffles. The counterweight blocks are engaged respectively with the connection recesses in the two connection segments. Each counterweight block has a body and a buckle. The body has an engaging channel extending from a center of the body to an edge of the body and being expandable. The engaging channel has an opening and two protrusions formed respectively on two inner sides of the body at a position adjacent to the center of the body to form an engaging space at an inner end of the engaging channel for being mounted around one of the connection segments at a position corresponding to a corresponding one of the connection recesses. The buckle has a first end and a second end. The first end is connected pivotally to the body and at a position on one of two sides of the engaging channel. The second end is connected detachably with the body at a position on the other one of the two sides of the engaging channel.

Other objects, advantages and novel features of the invention will become more apparent from the following detailed description when taken in conjunction with the accompanying drawings.

DETAILED DESCRIPTION OF PREFERRED EMBODIMENT

Figure 1:
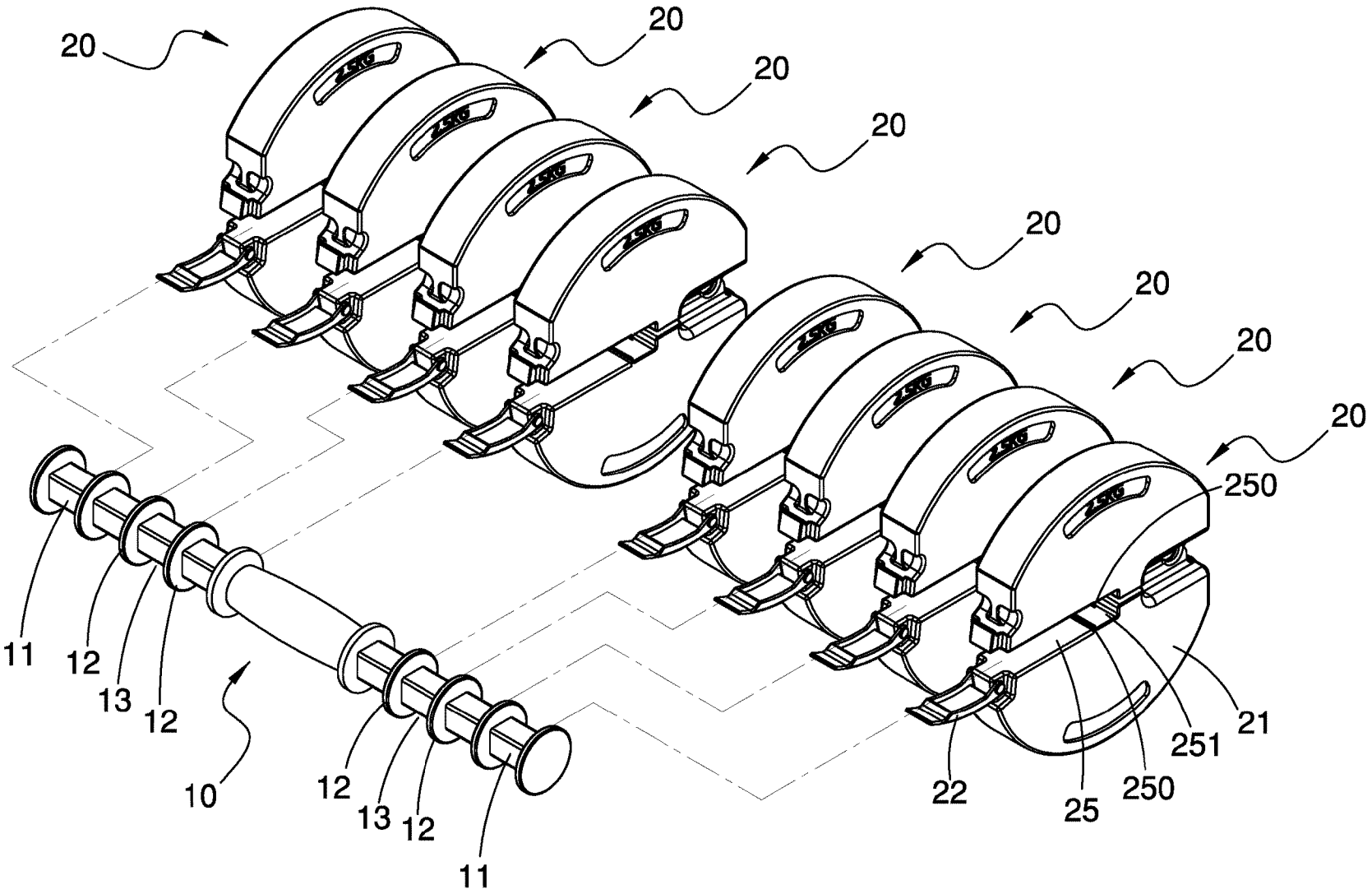
FIG. 1 is an exploded perspective view of a dumbbell in accordance with the present invention.
Figure 2:
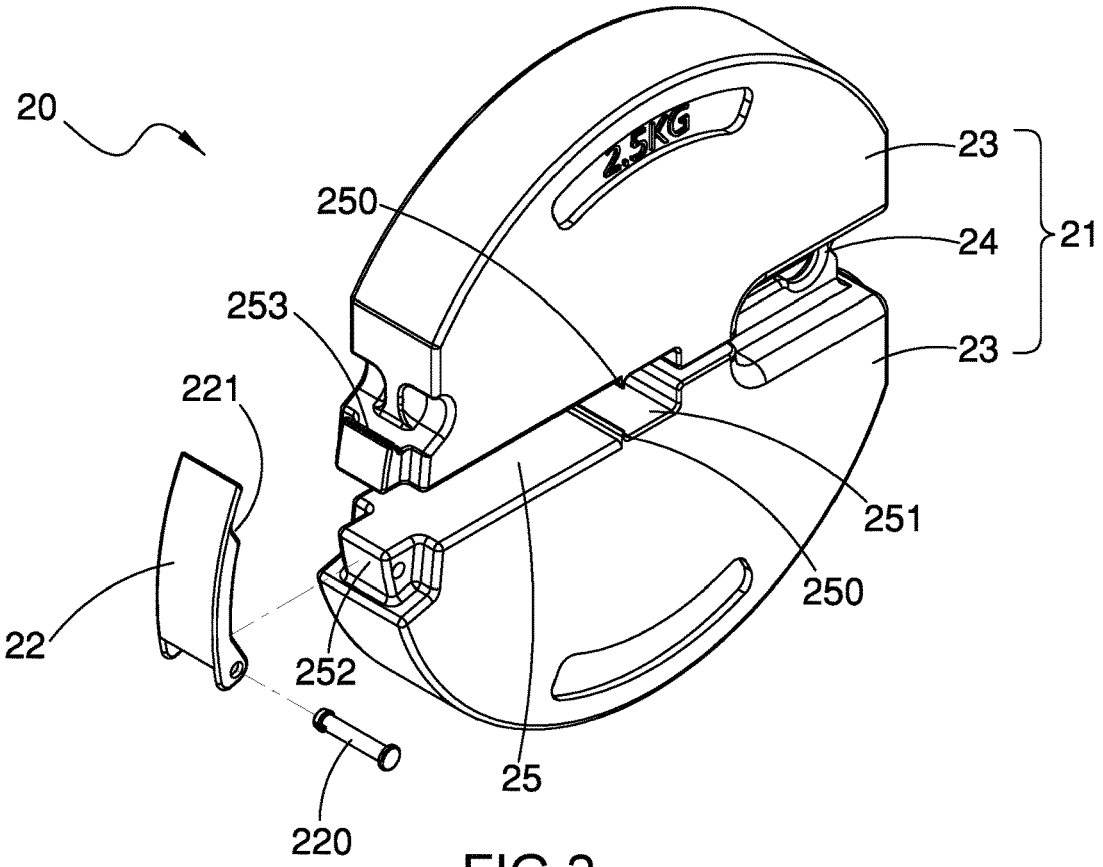
FIG. 2 is an enlarged exploded perspective view of a counterweight block of the dumbbell in FIG. 1.
Figure 3:
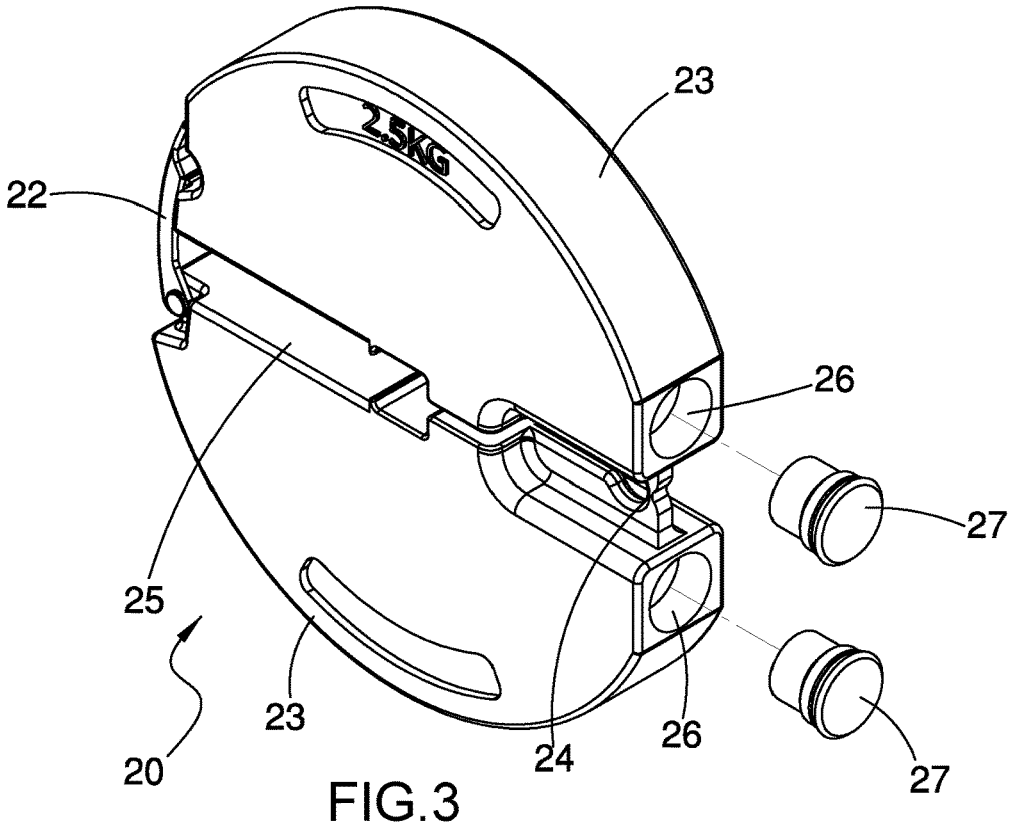
FIG. 3 is another enlarged exploded perspective view of a counterweight block of the dumbbell in FIG. 1.
Figure 4:
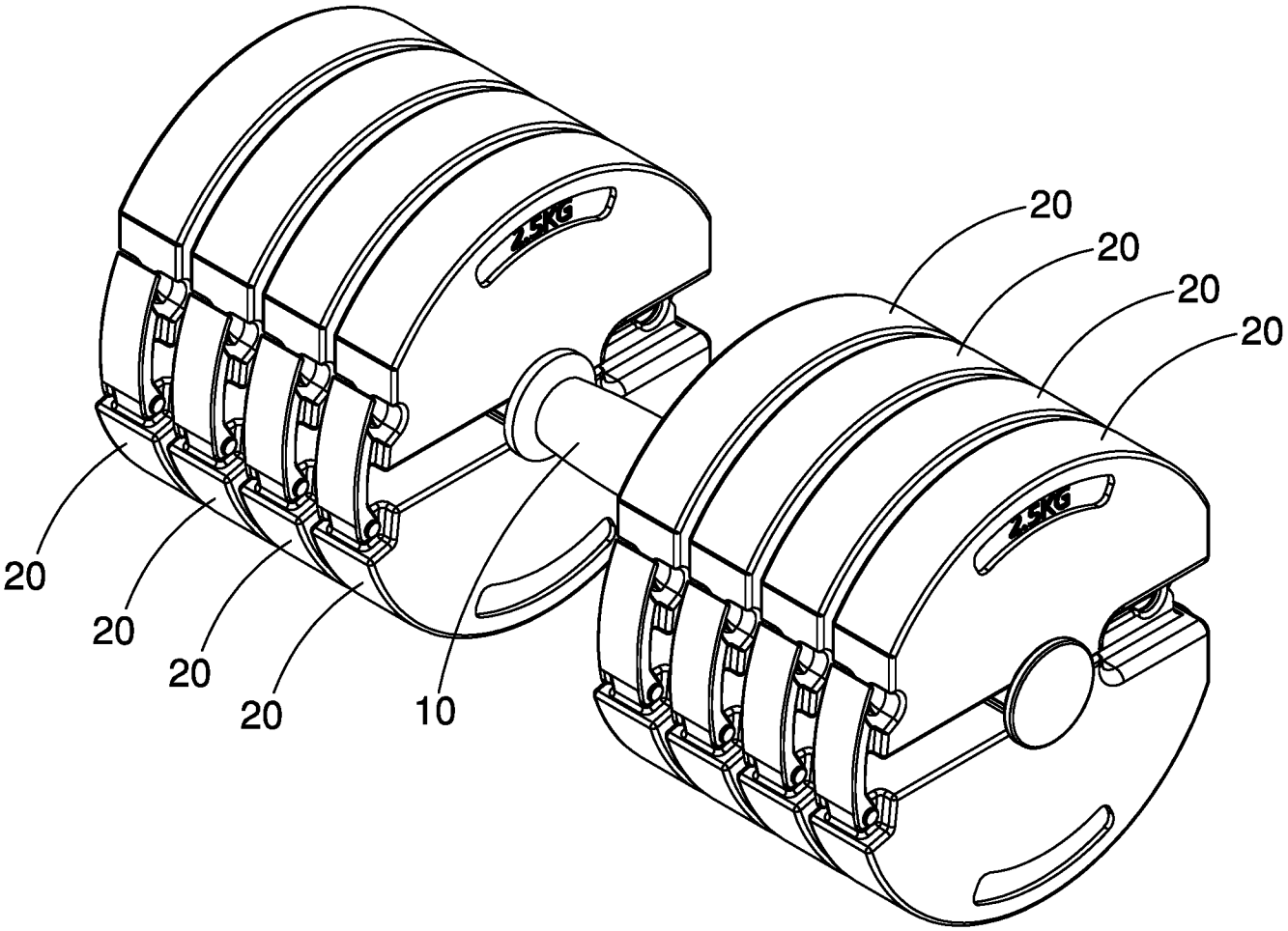
FIG. 4 is a perspective of the dumbbell in FIG. 1.

With reference to FIGS. 1 to 6, a dumbbell in accordance with the present invention comprises grip rod 10 and multiple counterweight blocks 20.

The grip rod 10 has two connection segments 11 formed respectively on two ends of the grip rod 10. Multiple baffles 12 are formed on each connection segment 11 at spaced interval to define multiple connection recesses 13 between the baffles 12.

The counterweight blocks 20 are engaged respectively with the connection recesses 13 in the two connection segments 11. Each counterweight block 20 comprises a body 21 and a buckle 22. The body 21 is formed of blow molding and comprises two halves 23 and a connection section 24 connected between the halves 23. Each half 23 has a specific thickness and is hollow. An engaging channel 25 is formed in the body 21 and extends from a center a center of the body 21 to an edge of the body 21, and the engaging channel 25 has an opening opposite the connection section 24 and is expandable from the connection section 24. The engaging channel 25 has two protrusions 250 formed respectively on two inner sides of the body at a position adjacent to the center of the body 21, such that an engaging space 251 is formed at an inner end of the engaging channel 25 to be mounted around one of the connection segments 11 at a position corresponding to a corresponding one of the connection recesses 13. A pivotal portion 252 and a hook portion 253 are formed respectively on the two halves 23 of the body 21 and respectively at the two sides of the engaging channel 25. Each half 23 has an inlet 26 formed in a side of the half 23 to allow filling objects, such as iron filings, sand or water to be filled within the half 23 via the inlet 26 and to make the half 23 have a specific weight. A cap 27 is attached to the inlet 26 to close the inlet 26 of each of the two halves 23. The buckle 22 has a first end connected pivotally to the pivotal portion 252 with a pivotal pin 220 and a second end having an engaging portion selectively engaged with the hook portion 253 to keep the engaging channel 25 from expanding.

Figure 5:
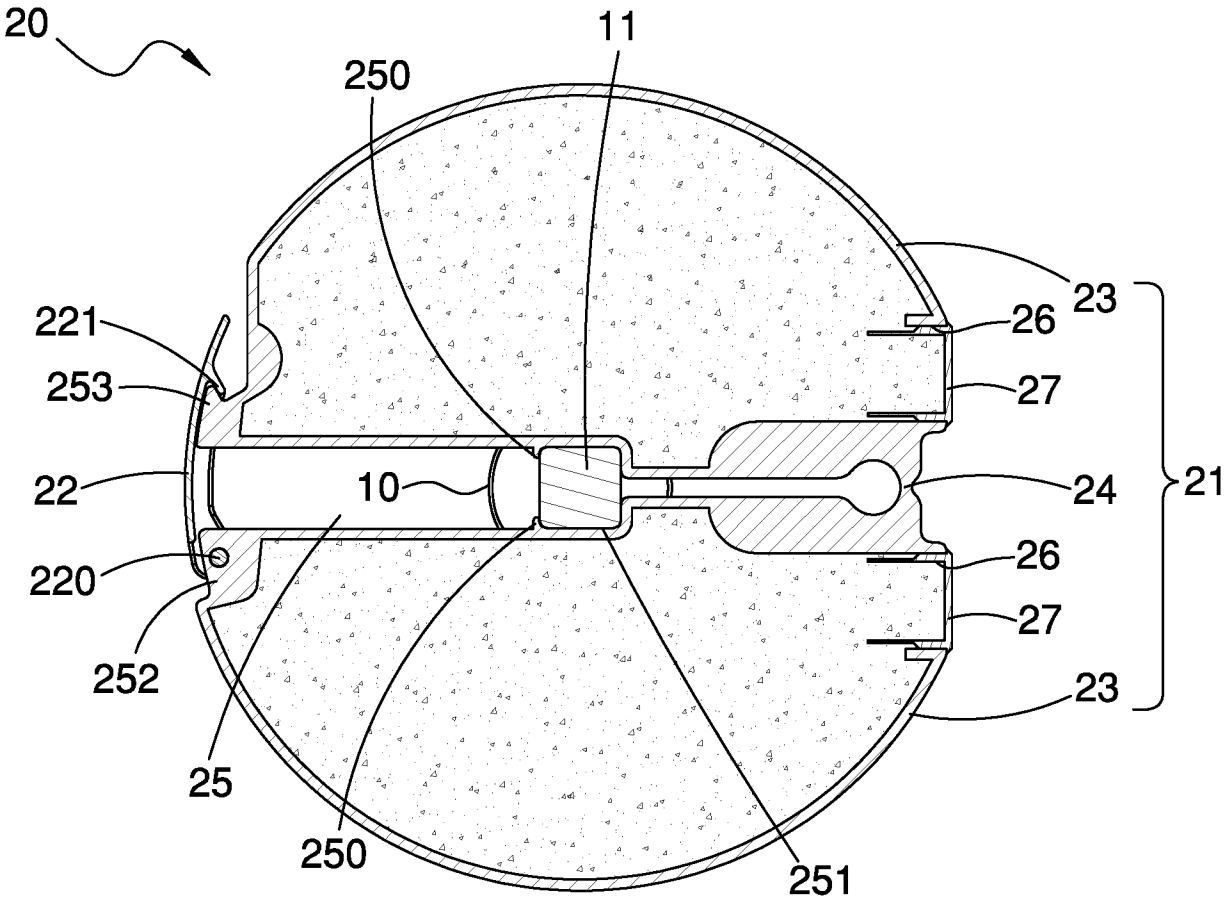
FIG. 5 is an enlarged cross sectional side view of dumbbell in FIG. 4.
Figure 6:
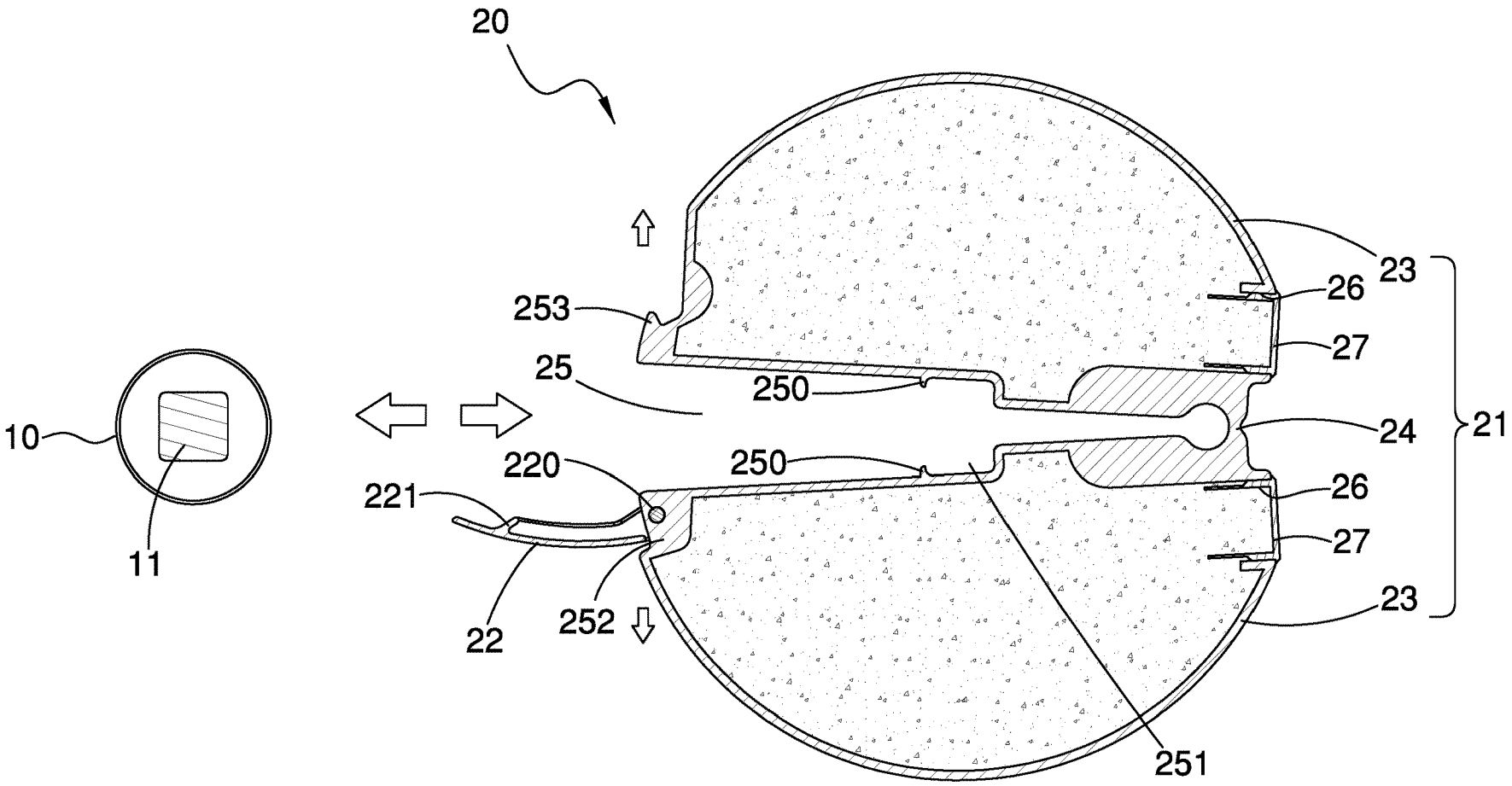
FIG. 6 is an enlarged operational cross sectional side view of the dumbbell in FIG. 4.

With reference to FIGS. 5 and 6, to adjust the weight of the dumbbell, the buckle 22 of one of the counterweight blocks 20 is pressed to pivot and to disengage the engaging portion 221 from the hook portion 253. Thus, the engaging channel 25 is expandable to allow one of one of the connection segment 11 to enter into the engaging channel 25. Consequently, the two halves 23 can be separated from each other slightly to expand the engaging channel 25, and one of the connection segments 11 of the grip rod 10 can be put into or removed from the engaging space 251. The buckle is then buckled again. accordingly, the weight of the dumbbell can be easily adjusted by increasing or decreasing the amounts of the counterweight blocks. in addition, each counterweight block can be attached to or detached from the grip rod 10 from a side direction of the grip rod 10 without being attached or detached from ends of the grip rod 10. Therefore, to adjust the weight of the dumbbell is easy, rapid and convenient. Specially, the counterweight blocks 20 can be mounted on any desired positions on the connection segments 11 of the grip rod 10, so the weight-adjusting for the dumbbell is versatile.

What is claimed is:

1. A dumbbell comprising:

a grip rod having two connection segments formed respectively on two ends of the grip rod, and each of the two connection segments having multiple baffles formed on the respective connection segment at spaced intervals to define multiple connection recesses between the multiple baffles; and multiple counterweight blocks engaged respectively with the multiple connection recesses in the two connection segments, and each of the multiple counterweight blocks comprising a body having an engaging channel extending from a center of the body to an edge of the body, the engaging channel of the body of each of the multiple counterweight blocks being expandable, and having an opening and two protrusions formed respectively on two inner sides of the body at a position adjacent to the center of the body to form an engaging space at an inner end of the engaging channel for being mounted around one of the two connection segments at a position corresponding to a corresponding one of the multiple connection recesses, and a buckle having a first end connected pivotally to the body and at a position on one of two sides of the engaging channel, and a second end connected detachably with the body at a position on the other one of the two sides of the engaging channel.

2. The dumbbell as claimed in claim 1, wherein the engaging channel of the body of each of the multiple counterweight blocks is selectively expandable.

3. The dumbbell as claimed in claim 2, wherein the body of each of the multiple counterweight blocks comprises two halves, each half having a specific weight, and a connection section connected between the two halves; the opening of the engaging channel of each of the multiple counterweight blocks is opposite the connection section of the respective counterweight block to enable the engaging channel to be expandable from the connection section; and the first end of the buckle of each of the multiple counterweight blocks is connected pivotally to one of the halves of the body of the respective counterweight block at a position adjacent to the opening of the engaging channel of the respective counterweight block, and the second end of the buckle of the respective counterweight block is connected detachably with the other half of the body of the respective counterweight block at a position adjacent to the opening of the engaging channel of the respective counterweight block.

4. The dumbbell as claimed in claim 3, wherein the body of each of the multiple counterweight blocks further has a pivotal portion and a hook portion formed respectively on the two halves of the body and respectively at the two sides of the engaging channel; and the first end of the buckle of each of the multiple counterweight blocks is connected pivotally to the pivotal portion of the body of the respective counterweight block with a pivotal pin, and the second end of the buckle of the respective counterweight block has an engaging portion selectively engaged with the hook portion on the body of the respective counterweight block to keep the engaging channel from expanding.

5. The dumbbell as claimed in claim 3, wherein each half of the body of each of the multiple counterweight blocks is hollow and has an inlet formed in a side of the respective half to allow filling objects to be filled within the respective half via the inlet and to make the respective half have a specific weight, a cap is attached to the inlet to close the inlet of each of the two halves.

6. The dumbbell as claimed in claim 1, wherein the body of each of the multiple counterweight blocks comprises two halves, each half having a specific weight, and a connection section connected between the two halves; the opening of the engaging channel of each of the multiple counterweight blocks is opposite the connection section of the respective counterweight block to enable the engaging channel to be expandable from the connection section; and the first end of the buckle of each of the multiple counterweight blocks is connected pivotally to one of the halves of the body of the respective counterweight block at a position adjacent to the opening of the engaging channel of the respective counterweight block, and the second end of the buckle of the respective counterweight block is connected detachably with the other half of the body of the respective counterweight block at a position adjacent to the opening of the engaging channel of the respective counterweight block.

7. The dumbbell as claimed in claim 6, wherein the body of each of the multiple counterweight blocks further has a pivotal portion and a hook portion formed respectively on the two halves of the body and respectively at the two sides of the engaging channel; and the first end of the buckle of each of the multiple counterweight blocks is connected pivotally to the pivotal portion of the body of the respective counterweight block with a pivotal pin, and the second end of the buckle of the respective counterweight block has an engaging portion selectively engaged with the hook portion on the body of the respective counterweight block to keep the engaging channel from expanding.

8. The dumbbell as claimed in claim 6, wherein each half of the body of each of the multiple counterweight blocks is hollow and has an inlet formed in a side of the respective half to allow filling objects to be filled within the respective half via the inlet and to make the respective half have a specific weight, a cap is attached to the inlet to close the inlet of each of the two halves.

9. The dumbbell as claimed in claim 1, wherein the two connection segments are cuboid rods.

10. The dumbbell as claimed in claim 1, wherein the body of each of the multiple counterweight blocks is made of blow molding.

* * * * *